US006860667B2

(12) United States Patent
Dowst et al.

(10) Patent No.: US 6,860,667 B2
(45) Date of Patent: Mar. 1, 2005

(54) WRITING INSTRUMENT WITH BIASED ROTATABLE ASSEMBLY

(76) Inventors: William Dowst, 2711 Washington Blvd., Bellwood, IL (US) 60104; Vitaly Pesikov, 2711 Washington Blvd., Bellwood, IL (US) 60104; Andrew Szczepanowski, 2711 Washington Blvd., Bellwood, IL (US) 60104; Neville E. Andrews, 2711 Washington Blvd., Bellwood, IL (US) 60104; Jim Salemme, 2711 Washington Blvd., Bellwood, IL (US) 60104

( * ) Notice: Subject to any disclaimer, the term of this patent is extended or adjusted under 35 U.S.C. 154(b) by 319 days.

(21) Appl. No.: 10/283,921

(22) Filed: Oct. 30, 2002

(65) Prior Publication Data

US 2003/0113155 A1 Jun. 19, 2003

Related U.S. Application Data

(63) Continuation of application No. 09/993,994, filed on Nov. 14, 2001, now abandoned.

(51) Int. Cl.[7] ..... B43K 24/02

(52) U.S. Cl. ..... 401/103; 401/99; 401/54

(58) Field of Search ..... 401/251, 249, 401/222, 54, 99, 103, 109, 112–114, 260

(56) References Cited

U.S. PATENT DOCUMENTS

| | | | | |
|---|---|---|---|---|
| 1,808,377 A | * | 6/1931 | Reichenbach | 401/158 |
| 2,487,340 A | | 11/1949 | Kleinsmith | |
| 2,592,406 A | | 4/1952 | Faltin | |
| 3,032,012 A | | 5/1962 | Lovejoy | |
| 3,192,904 A | | 7/1965 | Johmann | |
| 3,260,241 A | * | 7/1966 | Bross | 401/31 |

(List continued on next page.)

FOREIGN PATENT DOCUMENTS

| | | |
|---|---|---|
| BE | 495545 | 5/1950 |
| CZ | 79099 | 1/1950 |
| DE | 801 614 | 1/1951 |
| DE | 879 811 | 6/1953 |
| DE | 871 258 | 8/1953 |
| DE | 902 352 | 1/1954 |
| DE | 940 630 | 3/1956 |
| DE | 1 293 650 | 4/1969 |
| EP | 0 170 426 | 5/1986 |
| FR | 1.032.122 | 6/1953 |
| FR | 1.458.917 | 11/1966 |
| FR | 1.585.676 | 1/1970 |
| FR | 2.151.240 | 4/1973 |
| FR | 2.255.187 | 7/1975 |
| GB | 738740 | 10/1955 |
| GB | 988740 | 4/1965 |

(List continued on next page.)

*Primary Examiner*—Gregory Huson
*Assistant Examiner*—Huyen Le
(74) *Attorney, Agent, or Firm*—Marshall, Gerstein & Borun LLP

(57) ABSTRACT

A writing instrument is provided having an elongated shell having a longitudinal axis and an elongated assembly having a writing tip disposed at a first end of the elongated assembly. The elongated assembly is disposed at least partially in the elongated shell. The elongated assembly moves relative to the elongated shell between first and second positions along the longitudinal axis, a surface of the elongated assembly abutting a surface of the elongated shell with the elongated assembly in the first position and the surface of the elongated assembly spaced from the surface of the elongated shell with the elongated assembly in the second position. The writing instrument also includes a flexible bushing having a first end and a second end. The first end of the flexible bushing is secured to the elongated shell and the second end of the flexible bushing secured to the elongated assembly. The flexible bushing biases the elongated assembly toward the second position.

18 Claims, 8 Drawing Sheets

U.S. PATENT DOCUMENTS

| | | | | | |
|---|---|---|---|---|---|
| 3,281,933 | A | | 11/1966 | Fehling et al. | |
| 3,352,621 | A | | 11/1967 | Fehling et al. | |
| 3,396,569 | A | | 8/1968 | Miller | |
| 3,917,418 | A | * | 11/1975 | Lanoie | 401/116 |
| 3,945,735 | A | | 3/1976 | Nakashiki et al. | |
| 3,972,630 | A | | 8/1976 | Schenk | |
| 4,573,820 | A | | 3/1986 | Kirchhoff | |
| 4,594,015 | A | | 6/1986 | Pomares | |
| D299,660 | S | | 1/1989 | Gordo | |
| D302,442 | S | | 7/1989 | Gordo | |
| 5,009,533 | A | * | 4/1991 | Kageyama | 401/65 |
| 5,012,663 | A | | 5/1991 | Brown | |
| 5,172,994 | A | | 12/1992 | Brown | |
| 5,527,124 | A | | 6/1996 | Kolaric | |
| 5,893,674 | A | | 4/1999 | Dowst | |
| 5,988,921 | A | | 11/1999 | Medhin | |
| 6,039,493 | A | | 3/2000 | Seddon et al. | |
| 6,062,759 | A | * | 5/2000 | Dowst et al. | 401/209 |
| 6,126,350 | A | | 10/2000 | Kageyama et al. | |
| 6,428,232 | B2 | * | 8/2002 | McCauley et al. | 401/103 |

U.S. PATENT DOCUMENTS

| | | |
|---|---|---|
| GB | 1454828 | 12/1974 |
| IT | 496361 | 7/1954 |
| JP | 5-58358 | 8/1993 |
| SU | 776-706 | 1/1979 |
| TW | 322845 | 12/1997 |
| TW | 322846 | 12/1997 |
| WO | WO 91/14521 | 10/1991 |
| WO | WO 91/16210 | 10/1991 |
| WO | WO 97/22482 | 6/1997 |
| WO | WO 98/13216 | 4/1998 |

* cited by examiner

WRITING INSTRUMENT WITH BIASED ROTATABLE ASSEMBLY

This is a continuation of U.S. Ser. No. 09/993,994, filed Nov. 14, 2001, now abandoned which is incorporated herein by reference in its entirety.

TECHNICAL FIELD

The disclosure is directed to a writing instrument, and in particular, to a writing instrument with a biased rotatable assembly.

BACKGROUND

It is known in the art to design a writing instrument, such as a pen, which has an external shell in which a refill is housed. It is also known in the art to join the refill to the shell using bearings such that the refill is rotatable relative to the shell. It has been speculated that by using a rotatable refill the ink may be more uniformly applied to the paper.

It is further known in the art to have a pen wherein the shell has a longitudinal axis and the rotatable refill is movable along the longitudinal axis between first and second positions. In the first axial position, surfaces of the rotatable refill and the external shell cooperate to limit the relative rotational motion between the refill and the shell. In the second position, the rotatable refill is capable, under certain conditions, of rotating freely relative to the shell such that a preferred rotational orientation state is maintained between the refill and the shell. Preferably, the insert is maintained in the second axial position until such time as the user wishes to write with the writing instrument, at which time the refill is moved to the first axial position.

Several structures have been proposed to permit the refill to assume the second axial position when the writing instrument is not being used, i.e. ink is not applied to paper. One suggestion has been to provide a shell having a first open end and a second closed end, a refill having a first end with a writing point and a second end and a spring. The spring is disposed between the second end of the refill and the closed end of the shell to bias the refill towards its second position. Alternatively, a tubular shell, a refill having a first end with a writing point and a second end, an annular plug, and a pin are provided. The plug is disposed within the tubular shell and the pin passed through the hole in the plug and secured to the refill. With the shell at an downward incline, gravity acts against the refill to urge the refill toward the second position, separation of the refill from the shell prevented by the cooperation of pin and plug.

Both of these structures have their drawbacks. In the first device, shoulders must be formed on the shell and the refill to prevent the separation of the refill from the shell as a consequence of the biasing force provided by the spring. The shoulders make the manufacture of the refill and the shell complicated and expensive, and also increase the complexity and expense of the assembly process. In the second device, while the pin eliminates the necessity of providing shoulders to retain the refill within the shell, the refill is only urged towards the second position if the shell is held relatively level or at a downward angle. If the shell is placed at an upward angle, the force of gravity actually encourages the refill toward the first position, thereby inhibiting the free rotation of the refill relative to the shell.

SUMMARY

A writing instrument is provided. The writing instrument has an elongated shell with a longitudinal axis and an elongated assembly having a writing tip disposed at a first end of the elongated assembly. The elongated assembly is disposed at least partially in the elongated shell. The elongated assembly moves relative to the elongated shell between first and second positions along the longitudinal axis, a surface of the elongated assembly abutting a surface of the elongated shell with the elongated assembly in the first position and the surface of the elongated assembly spaced from the surface of the elongated shell with the elongated assembly in the second position. The writing instrument also includes a flexible bushing having a first end and a second end. The first end of the flexible bushing is secured to the elongated shell and the second end of the flexible bushing secured to the elongated assembly. The flexible bushing biases the elongated assembly toward the second position.

A writing instrument is also provided including an elongated shell with a longitudinal axis and an elongated assembly. The elongated assembly includes a writing tip disposed at a first end of the elongated assembly at a fixed angle relative to the longitudinal axis and at an offset to the longitudinal axis, and a weight at an offset to the longitudinal axis. The elongated assembly is disposed at least partially in the elongated shell. The elongated assembly moves relative to the elongated shell between first and second positions along the longitudinal axis, a locking surface of the elongated assembly abutting a locking surface of the elongated shell with the elongated assembly in the first position and the surface of the elongated assembly spaced from the surface of the elongated shell with the elongated assembly in the second position. The writing instrument also includes a cup-shaped flexible bushing having an annular flange at a first end and an annular disc at a second end, the flange secured between axially facing shoulders of the elongated shell and the annular disc secured between axially facing shoulders of the elongated assembly. The flexible bushing biases the elongated assembly toward the second position.

DESCRIPTION OF THE EMBODIMENTS

Figure 1:
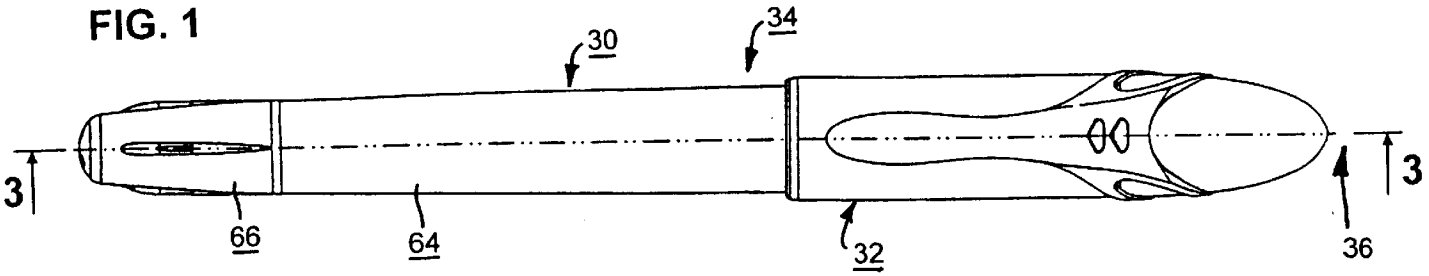
FIG. 1 is a plan view of a writing instrument.
Figure 2:
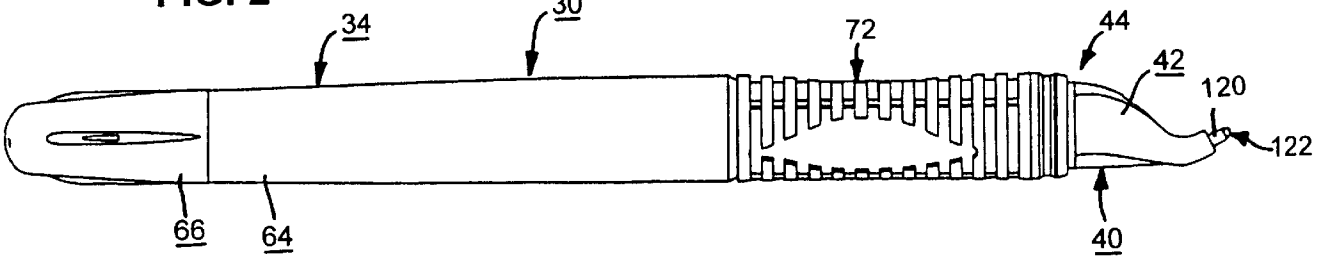
FIG. 2 is a side view of the writing instrument of FIG. 1 with the cap removed.

FIG. 1 shows a writing instrument 30 including a cap 32 and an elongated shell 34. The elongated shell 34 has a longitudinal axis 36. As seen in FIG. 2, an elongated assembly 40 having a writing tip 42 at a first end 114 of the elongated assembly 40 is disposed at least partially in the elongated shell 34.

The elongated assembly 40 is movable relative to the elongated shell 34 between first and second positions along the longitudinal axis 36. In the first position, a surface 46 of the elongated assembly 40 abuts a surface 48 of the elongated shell 34. In the second position, the surface 46 of the elongated assembly 40 is spaced from the surface 48 of the elongated shell 34 (as in FIG. 3). With the elongated assembly 40 in the first position, the rotational motion of the elongated assembly 40 relative to the elongated shell 34 is substantially limited, whereas with the elongated assembly 40 in the second position, the elongated assembly 40 is substantially free to rotate relative to the elongated shell 34.

A flexible bushing 50 having a first end 52 and a second end 54 is also included. The first end 52 of the flexible bushing 50 is secured to the elongated shell 34, while the second end 54 of the flexible bushing 50 is secured to the elongated assembly 40. The flexible bushing 50 biases the elongated assembly 40 toward the second position relative to the elongated shell 34.

The writing instrument 30 has at least several advantages, which may be considered separately or in combination. One advantage is that the flexible bushing 50 biases the elongated assembly 40 toward the second position regardless of the orientation of the elongated shell 34, permitting rotation to occur even when the elongated shell 34 is inclined upwardly, as might occur if the writer were writing on a vertical wall, for example. Additionally, the bushing 50 secures the elongated assembly 40 to the elongated shell 34, such that other structures for retaining the elongated assembly 40 within the elongated shell 34 are not required. This simplifies the manufacture of the constituent elements, elongated shell 34 and elongated assembly 40, as well as the assembly of the elongated assembly 40 and the elongated shell 34 into the writing instrument 30. The simplified manufacture of the writing instrument 30, and in particular the elongated shell 34 and the elongated assembly 40, reduces the cost of manufacturing and assembling the writing instrument 34.

Figure 3:
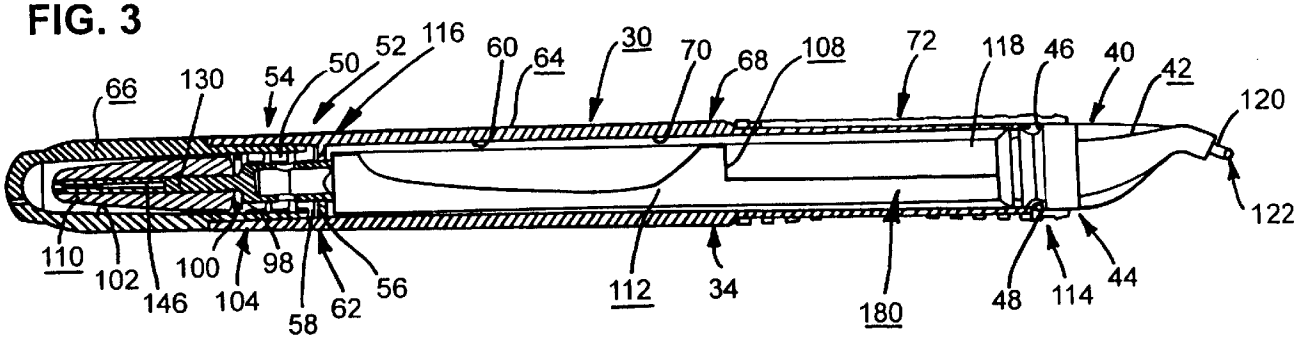
FIG. 3 is a cross-sectional view of the pen of FIG. 1 taken about line 3—3 in FIG. 1 with the cap removed.

The structure of the writing instrument 30 is now explained in greater detail starting with FIG. 3.

The elongated shell 34 has axially facing shoulders 56, 58 on an interior surface 60. The axially facing shoulders 56, 58 define an angular groove 62. The first end 52 of the flexible bushing 50 is disposed in the annular groove 62. Preferably, the first end 52 of the bushing 50 is seated in the annular groove 62 such that the first end 52 abuts at least one of the axially facing shoulders 56, 58 of the elongated shell 34.

Figure 6:
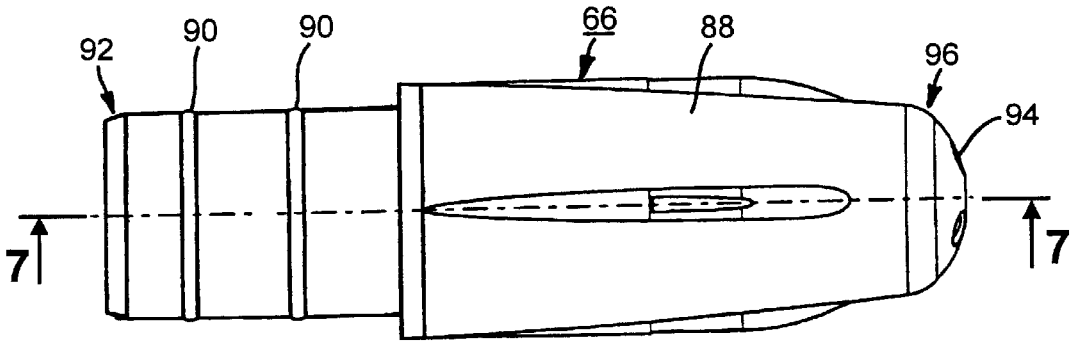
FIG. 6 is a side view of an end plug.
Figure 7:
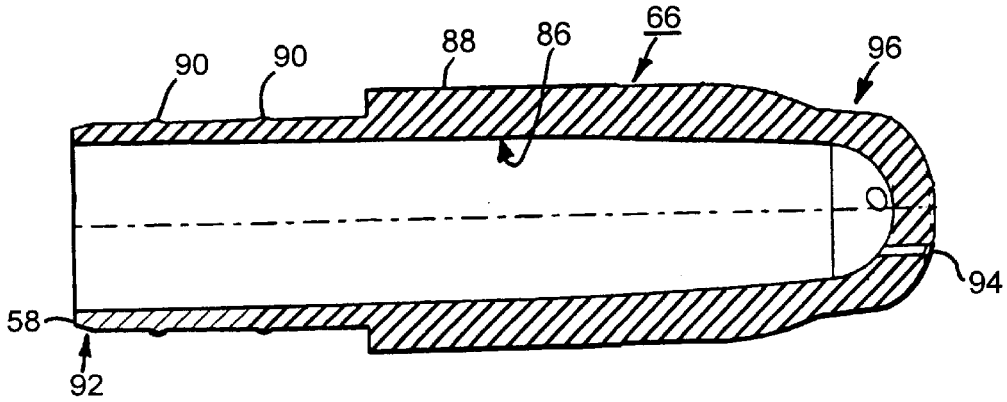
FIG. 7 is a cross-sectional view of the end. plug of FIG. 6 taken about line 7—7 in FIG. 6.

According to a preferred embodiment, the shoulders 56, 58 are formed on separate structures that collectively define the elongated shell 34. In particular, the elongated shell 34 as shown includes a barrel 64 (FIGS. 4 and 5) and an end plug 66 (FIGS. 6 and 7). The barrel 64 and the end plug 66 are preferably made of a rigid plastic, although other materials may be used.

Figure 4:
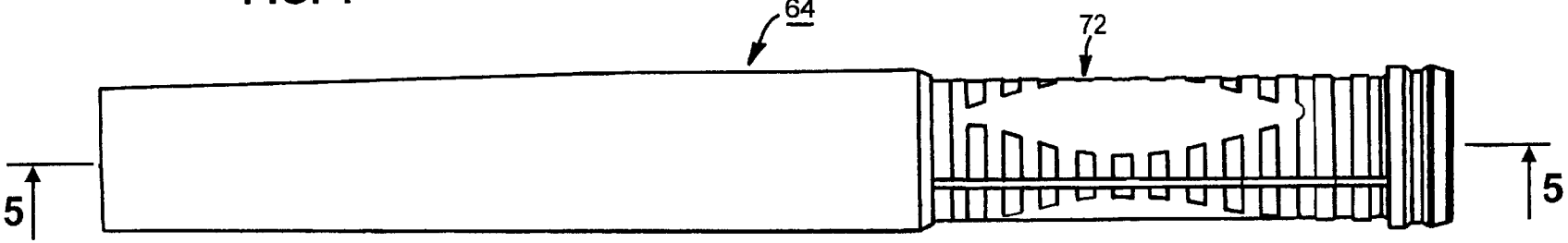
FIG. 4 is a side view of a barrel.
Figure 5:
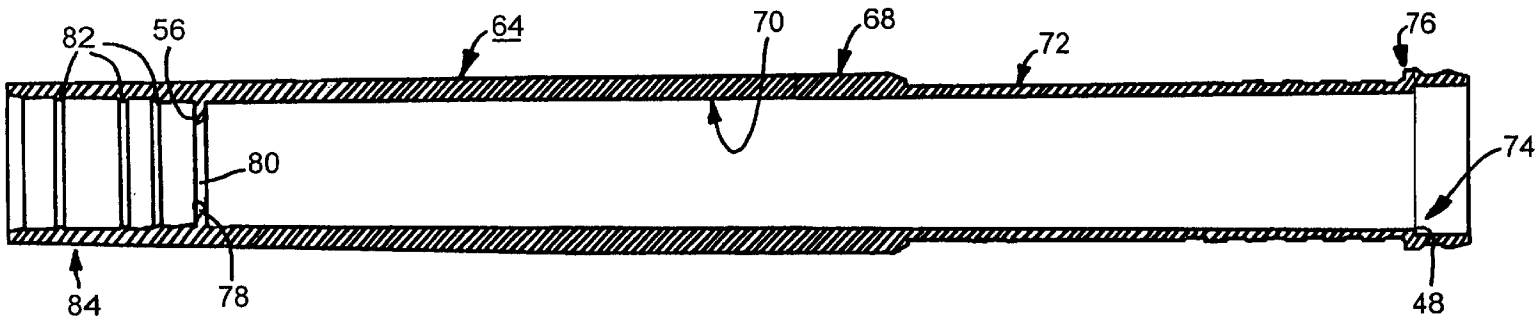
FIG. 5 is a cross-sectional view of the barrel of FIG. 4 taken about line 5—5 in FIG. 4.

Turning now to FIGS. 4 and 5, the barrel 64 has a stepped external surface 68 and a stepped internal surface 70. The external surface 68 includes a grip portion 72 over which a softer plastic material may be applied. The internal surface 70 includes a shoulder 74 at the first end 76 of the barrel 64. The shoulder 74 defines the surface 48. The internal surface 70 also includes an inwardly depending annular flange 78 with a passage 80 therethrough. The annular flange 78 defines the shoulder 56. Additionally, a series of annular ribs 82 are formed at the second end 84 of the barrel 64.

As shown FIGS. 6 and 7, the end plug 66 has an internal surface 86 and an external surface 88. Ribs 90 are formed on the external surface 88 at a first end 92 of the plug 66. The ribs 90 cooperate with the ribs 82 of the barrel 64 to secure the plug 66 to the barrel 64. Additionally, the end 92 defines the axial shoulder 58. One or more apertures 94 are formed in the second end 96 of the plug to vent the interior of the shell 34.

Similar to the elongated shell 34 discussed above, the elongated assembly 40 has axially facing shoulders 98, 100. The shoulders 98, 100 are formed on an exterior surface 102 of the elongated assembly 40. The second end 54 of the bushing 50 is disposed between-the axially facing shoulders 98, 100 of the elongated assembly 40. In particular, the axially facing shoulders 98, 100 define an annular groove 104, and the second end 54 of the bushing 50 abuts the axially facing shoulders 98, 100 with the second end 54 disposed in the annular groove 104.

As seen in FIG. 3, the elongated assembly 40 preferably includes the writing tip 42, a tubular member 108, an end cap 110, and a weight 112. Preferably, the tubular member 108 defines the shoulder 98, while the end cap 110 defines the shoulder 100. Both the tubular member 108 and the end cap 110 are preferably made of a rigid plastic material, although other materials maybe used.

Figure 12:
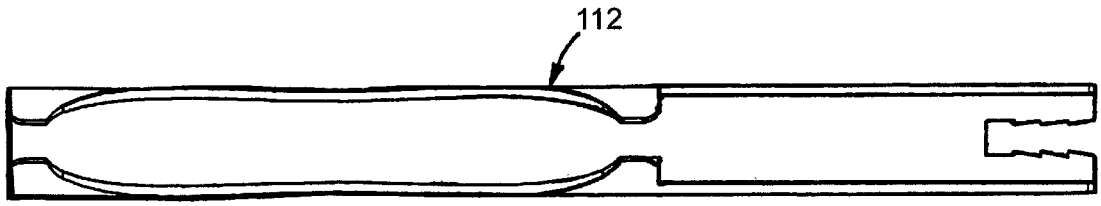
FIG. 12 is a plan view of a weight.
Figure 13:
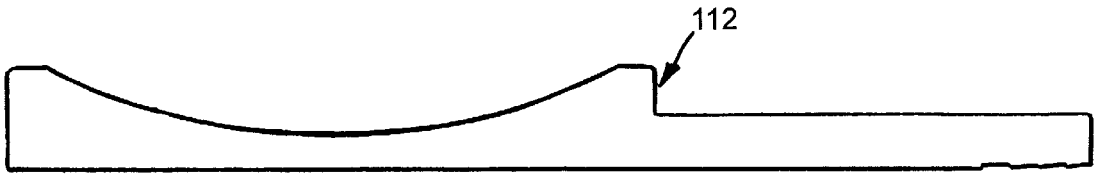
FIG. 13 is a side view of the weight of FIG. 12.
Figure 14:
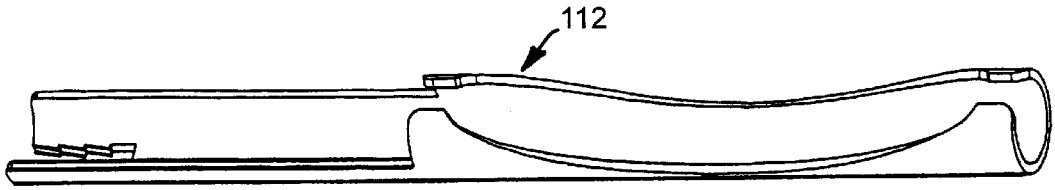
FIG. 14 is an isometric view of the weight of FIG. 12.

The structure of the tubular member 108 and its assembly with the writing tip 42 and weight 112 is now explained with reference to FIG. 3. The tubular member 108 is of generally cylindrical shape, and has the first end 114, a second end 116, and a stepped external surface 118. The writing tip 42 having a ball point 120 with a ball 122 is attached to the first end 114. With the tubular member 108 inserted into the elongated shell 34, the ball point 120 is disposed at a fixed angle relative to the longitudinal axis 36 of the shell 34 and the ball 122 is at an offset relative to the longitudinal axis 36. The weight 112 is attached to the external surface 118 of the tubular member 108, and is shaped (as shown in FIGS. 12–14) such that it is substantially disposed over half of the exterior surface 118 of the tubular member 108. Consequently, the weight 112 acts at an offset relative to the longitudinal axis 36.of the elongated shell 34.

Figure 8:
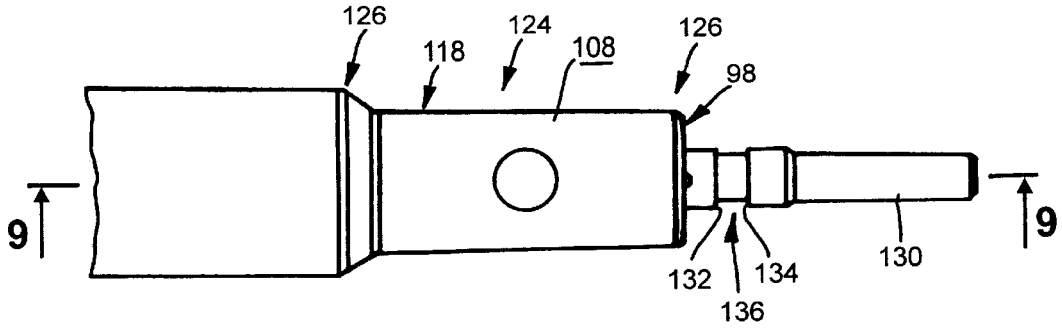
FIG. 8 is a partial bottom view of a tubular member.
Figure 9:
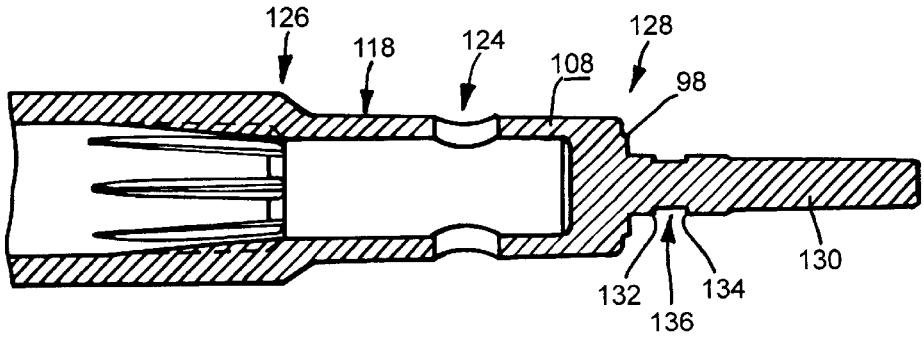
FIG. 9 is a partial cross-sectional view of the tubular member of FIG. 8 taken about line 9—9 in FIG. 8.

Referring to FIGS. 8 and 9, the external surface 118 of the tubular member 108 tapers to define a cylindrical section 124 that is disposed through the passage 80 in the flange 78 of the barrel 64 when the writing instrument 30 is assembled. A first end 126 of the cylindrical section 124 is tapered to better cooperate with the tapered passage 80 in the annular flange 78. A second end 128 of the cylindrical section 124 defines the shoulder 98.

As also seen in FIGS. 8 and 9, a post 130 is attached to the second end 128 of the cylindrical section 124 and has shoulders 132, 134 defined thereon. The shoulders 132, 134 define an annular groove 136 therebetween. The annular groove 136 cooperates with a portion of the end cap 110 as will be explained in greater detail below.

Figure 10:
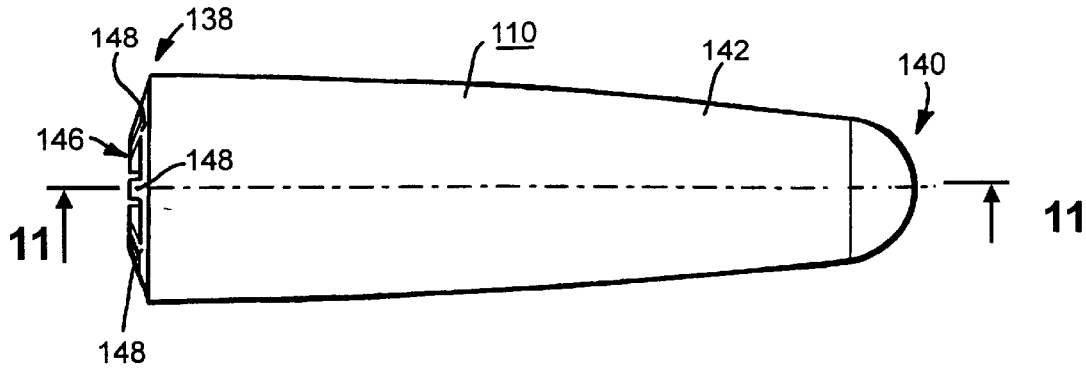
FIG. 10 is a side view of an end cap.
Figure 11:
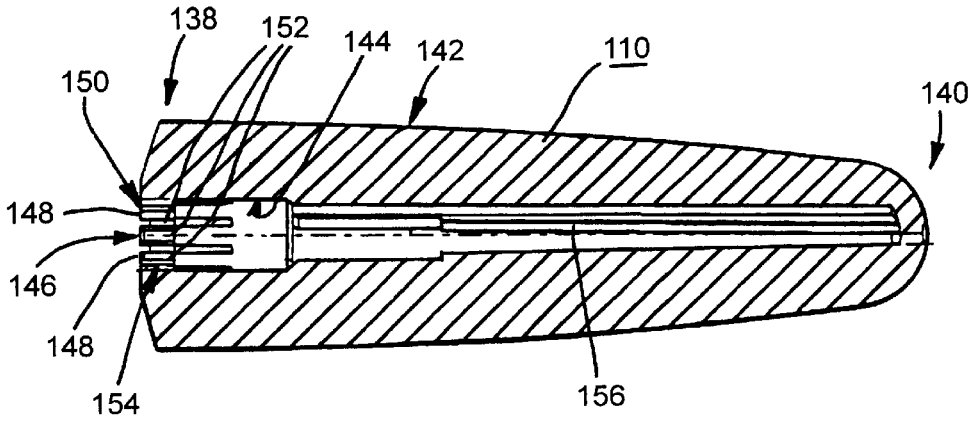
FIG. 11 is a cross-sectional view of the end cap of FIG. 10 taken about line 11—11 in FIG. 10.

Turning now to FIGS. 10 and 11, the end cap 110 has an open end 138 and a closed end 140. The end cap 110 also has a substantially smooth exterior surface 142 and a stepped interior surface 144. The shape of the end cap 110 is complimentary to the interior surface 86 of the end plug 66, and is substantially bullet-shaped.

The open end 138 of the end cap 110 defines a hole 146 into which the post 130 of the tubular member 108 is disposed when the elongated assembly 40 is assembled. The end cap 110 further includes a plurality of fingers 148 disposed about the perimeter 150 of the hole 146. While the fingers 148 may be formed of the same material as the end cap 110, the fingers 148 are flexible and resilient.

Each finger 148 has a locking projection 152 formed at the end 154 thereof. The locking projections 152 are received in the annular groove 136 defined by the facing shoulders 132, 134 of the post 130, thereby securing the end cap 110 to the tubular member 108. The end cap 110 may also include a series of ribs 156 which cooperate with an end 158 of the post 130 to better seat the locking projections 152 in the annular groove 136.

Figure 15:
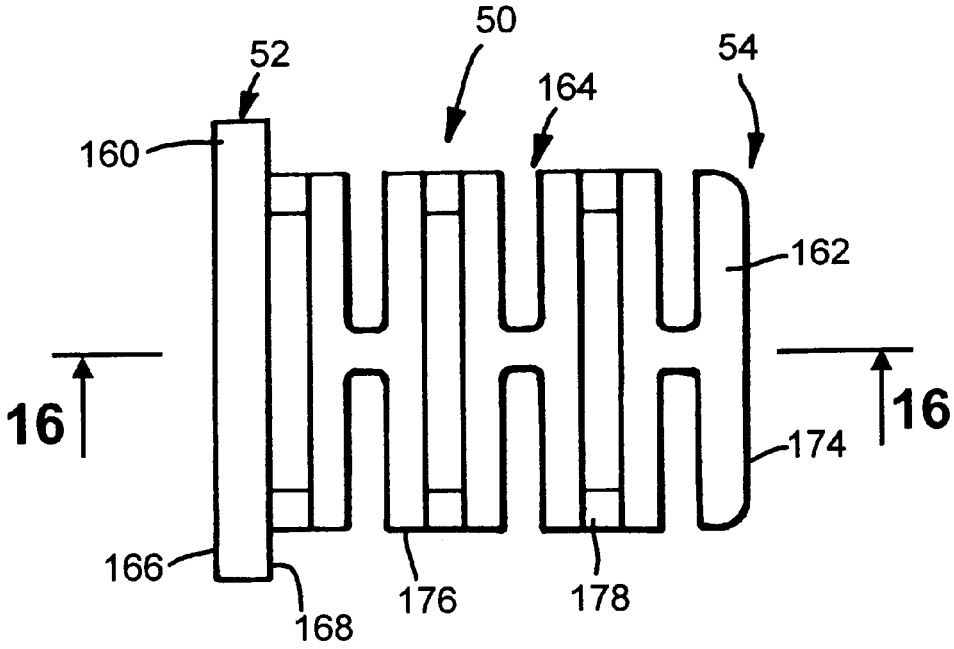
FIG. 15 is a side view of a flexible bushing.
Figure 16:
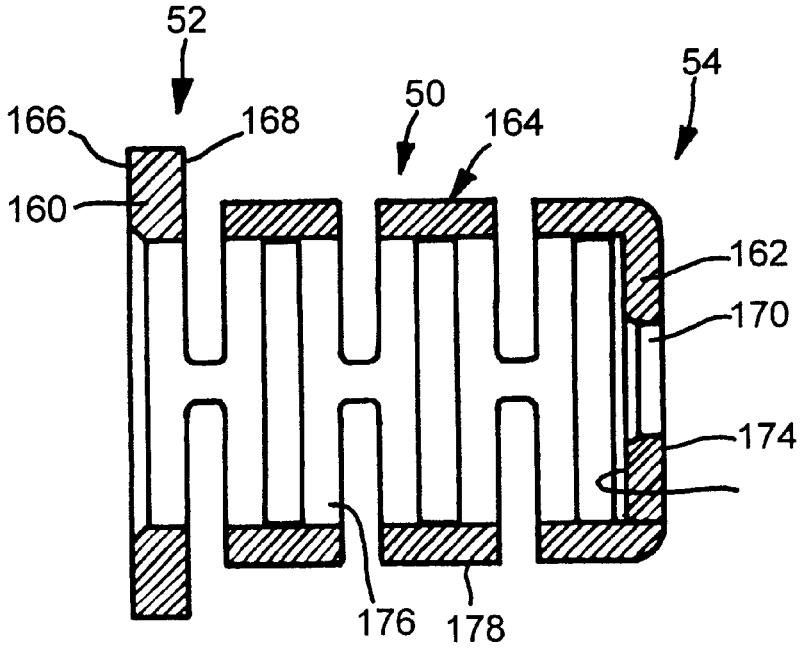
FIG. 16 is a cross-sectional view of the flexible bushing of FIG. 15 taken about line 16—16 in FIG. 15.

The flexible bushing 50 is shown in FIGS. 15 and 16. As will be recognized, the bushing 50 has a cup-shape. In particular, the bushing 50 has an annular flange 160 at its first end 52 and an annular disk 162 at its second end 54. A cylindrical section 164 joins the annular flange 160 and the annular disk 162. Preferably, the annular flange 160, the annular disk 162, and the cylindrical section 164 are formed as a one-piece structure using a semi-rigid or soft plastic material, although other materials may be used.

The annular flange 160 has shoulders 166, 168. As shown in FIG. 3, shoulder 166 is spaced from the shoulder 56 of the barrel 34, while the shoulder 168 abuts the shoulder 58 of the end plug 66. The annular disk 162 has a passage 170 therethrough for receiving the post 130 of the tubular member 108. The annular disk 170 also has shoulders 172, 174 which cooperate with shoulder 98 of the tubular member 108 and shoulder 100 of the end cap 110. The central cylindrical section 164 of the flexible bushing 50 is made up of series of annular disks 176 joined by longitudinally extending ribs 178. The cooperation of the disks 176 and the ribs 178 provide a spring-like function and a biasing force that is utilized in the writing instrument 30 to urge the elongated assembly 40 to its second position axially relative to the elongated shell 34.

The writing instrument 30 may be assembled as follows.

In general terms, the writing tip 42, tubular member 108, end cap 110, and weight 112 are combined to form a sub-assembly 180. The sub-assembly 180 is then inserted into the first end 76 of the barrel 64. The flexible bushing 50 is disposed into the second end 84 of the barrel 64, and the end cap 110 is secured to the tubular member 108. The end plug 66 is then secured to the barrel 64, and the assembly is complete.

In particular, after the sub-assembly 180 is assembled, it is disposed into the barrel 64 such that the cylindrical section 124 of the tubular member 108 is disposed through the passage 80 in the internal flange 78 of the barrel 64. The flexible bushing 50 is then disposed into the open end 84 of the barrel 64 until the cup-shaped flexible bushing 50 appears to be seated on the cylindrical section 124 of the tubular member 108. In this position, the shoulder 172 of the bushing 50 abuts the shoulder 98 of the tubular member 108.

The end cap 110 is then disposed in the open end 84 of the barrel 64 such that the post 130 is disposed into the hole 146. The cap 110 is advanced axially along the post 130 until the locking projections 152 are received within the annular groove 136 of the post 130. Thus secured, the shoulder 100 of the end cap 110 abuts the shoulder 174 of the bushing 50.

The first end 92 of the end plug 66 is then advanced into the open end 84 of the barrel 64. The end 92 of the end plug 66 is advanced into the open end 84 of the barrel 64 until the ribs 82 completely cooperate with the ribs 90 to secure the end plug 66 to the barrel 64. The assembly is then complete.

The operation of the writing instrument 30 is now explained with reference to FIG. 3.

The bushing 50 biases the elongated assembly 40 into its second position as shown. In the second position, the elongated assembly 40 is substantially free to rotate relative to the elongated shell 34 under the influence of the offset weight 112. The weight 112 maintains the desired orientation of the writing tip 42, and in particular, the ball point 120, relative to the elongated shell 34.

When the ball point 120, and in particular the ball 122, is applied to a writing surface, a downward force on the external shell 34 causes the shoulders 46, 48 of the elongated assembly 40 and the elongated shell 34 to abut, such that the rotational motion of the elongated assembly 40 relative to the elongated shell 34 is substantially limited. It is not necessary that the relative motion be entirely prevented, so long as the elongated assembly 40 is substantially arrested in its rotational motion relative to the elongated shell 34.

As mentioned above, the writing instrument 30 has multiple advantages. The use of the flexible bushing 50 maintains the freedom of relative rotational motion between the elongated shell 34 and the elongated assembly 40 irrespective of the orientation of the elongated shell 34. Additionally, a separate advantage of the writing assembly 30 is that the manufacture and assembly of the writing instrument 30 is simplified. Further, by shaping the flexible bushing 50 in a cup-shape and disposing the cylindrical portion 124 of the tubular member 108 therein, the crushing of the flexible bushing 50 is limited in cases of sudden shock.

Figure 17:
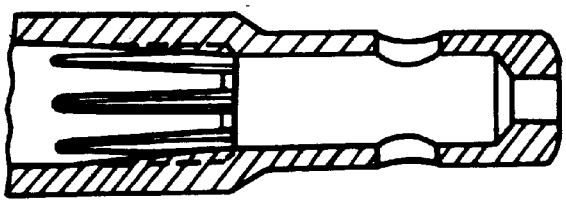
FIG. 17 is a partial cross-sectional view of an alternative structure of a tubular member.
Figure 18:
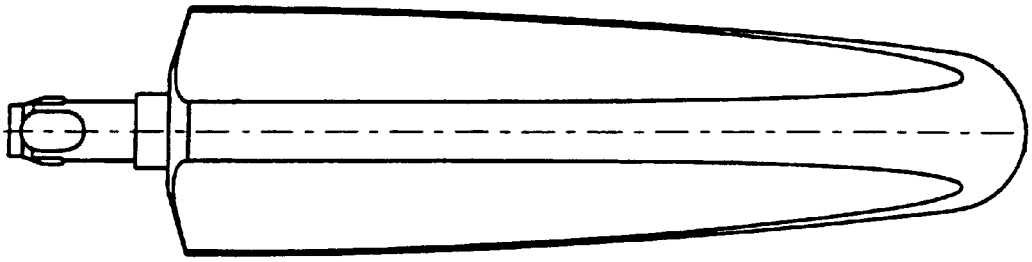
FIG. 18 is a side view of an alternative structure of an end cap.

It will be recognized that numerous modifications and alternatives may be purposed to the writing instrument 30 described above. For example, rather than using interlocking ribs 82, 90 to secure the plug 66 to the barrel 64, or interlocking groove 136 and projections 152 to secure the cap 110 to the tubular member 108, threaded connections may be used. As a further alternative, rather than having a solid post 130 attached to the tubular member 108 received in the hole 146 of the end cap 110, the structures may be reversed such that the hole is defined in the tubular member 108 and the post is part of the end cap 110, as shown in FIGS. 17 and 18.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

We claim:

1. A writing instrument comprising:

an elongated shell having a longitudinal axis;

an elongated assembly having a writing tip disposed at a first end of the elongated assembly, the elongated assembly disposed at least partially in the elongated shell, the elongated assembly moveable relative to the elongated shell between first and second positions along the longitudinal axis, a surface of the elongated assembly abutting a surface of the elongated shell with the elongated assembly in the first position and the surface of the elongated assembly spaced from the surface of the elongated shell with the elongated assembly in the second position; and a flexible bushing having a first end and a second end, the first end of the flexible bushing secured to the elongated shell and the second end of the flexible bushing secured to the elongated assembly, the flexible bushing biasing the elongated assembly toward the second position.

2. The writing instrument according to claim 1, wherein:

the elongated shell has axially facing shoulders on an interior surface and the elongated assembly has axially facing shoulders on an exterior surface, the first end of the flexible bushing disposed between the axially facing shoulders of the elongated shell and the second end disposed between the axially facing shoulders of the elongated assembly.

3. The writing instrument according to claim 2, wherein the axially facing shoulders of the elongated shell define an annular groove and the axially facing shoulders of the elongated assembly define an annular groove.

4. The writing instrument according to claim 2, wherein the first end of the flexible bushing abuts at least one of the axially facing shoulders of the elongated shell and the second end abuts the axially facing shoulders of the elongated assembly.

5. The writing instrument according to claim 2, wherein:

the flexible bushing defines a cup-shaped spring having an annular flange at the first end and an annular disk at the second end, the annular flange disposed between the axially facing shoulders of the elongated shell and the annular disk disposed between the axially facing shoulders of the elongated assembly.

6. The writing instrument according to claim 5, wherein the elongated assembly has a post which is disposed through the central aperture.

7. The writing instrument according to claim 1, wherein the elongated shell comprises a barrel and an end plug, the barrel secured to the end plug and the first end of the flexible busing secured between the barrel and the end plug.

8. The writing instrument according to claim 7, wherein:

the barrel and the end plug have shoulders which face along the longitudinal axis and are separated so as to define a space therebetween, and the flexible bushing includes an annular flange which is disposed in the space defined between the shoulders of the barrel and the end plug.

9. The writing instrument according to claim 8, wherein the annular flange abuts the shoulders of the barrel and the end plug.

10. The writing instrument according to claim 1, wherein the elongated assembly comprises a tubular member and an end cap, the tubular member secured to the end cap and the second end of the flexible bushing secured between the tubular member and the end cap.

11. The writing instrument according to claim 10, wherein:

the tubular member and the end cap have shoulders which face along the longitudinal axis and are separated so as to define a space therebetween, and the flexible bushing includes a disc which is disposed in the space defined between the shoulders of the tubular member and the end plug.

12. The writing instrument according to claim 11, wherein the disc comprises an annular disc having a hole therethrough, the disc abutting the shoulders of the tubular member and the end cap with one of the tubular member and the end cap having a post disposed through the hole and received in the other of the tubular member and the end cap.

13. The writing instrument according to claim 12, wherein:

the other of the tubular member and the end cap includes at least one flexible finger having a locking projection, and the post has a groove that receives the locking projection with the post received in the other of the tubular member and the end cap.

14. The writing instrument according to claim 12, wherein:

the other of the tubular member and the end cap defines a threaded hole, and the post comprises a threaded post that cooperates with the threaded hole when the post is received in the other of the tubular member and the end cap.

15. The writing instrument according to claim 1, wherein the writing tip is disposed at a fixed angle relative to the longitudinal axis.

16. The writing instrument according to claim 15, wherein the writing tip includes a writing point which is offset from the longitudinal axis.

17. The writing instrument according to claim 1, wherein the elongated assembly includes a weight at an offset to the longitudinal axis.

18. A writing instrument comprising:

an elongated shell having a longitudinal axis;

an elongated assembly having a writing tip disposed at a first end of the elongated assembly at a fixed angle relative to the longitudinal axis and at an offset to the longitudinal axis and a weight at an offset to the longitudinal axis, the elongated assembly disposed at least partially in the elongated shell, the elongated assembly moveable relative to the elongated shell between first and second positions along the longitudinal axis, a locking surface of the elongated assembly abutting a locking surface of the elongated shell with the elongated assembly in the first position and the surface of the elongated assembly spaced from the surface of the elongated shell with the elongated assembly in the second position; and a cup-shaped flexible bushing having an annular flange at a first end and an annular disc at a second end, the flange secured between axially facing shoulders of the elongated shell and the annular disc secured between axially facing shoulders of the elongated assembly, the flexible bushing biasing the elongated assembly toward the second position.

* * * * *